United States Patent [19]

Flor

[11] 4,429,938

[45] Feb. 7, 1984

[54] LOCKING DEVICE FOR INTERFITTING MEMBERS

[75] Inventor: Joseph R. Flor, Livingston, N.J.

[73] Assignee: Midland-Ross Corporation, Cleveland, Ohio

[21] Appl. No.: 337,378

[22] Filed: Jan. 6, 1982

[51] Int. Cl.[3] ..... H01R 13/625

[52] U.S. Cl. ..... 339/90 R; 339/DIG. 2; 403/349

[58] Field of Search ..... 339/88 R, 90 R, 90 C, 339/DIG. 2; 403/349; 285/394, 396

[56] References Cited

U.S. PATENT DOCUMENTS

| | | | |
|---|---|---|---|
| 931,327 | 8/1909 | Manzel | 285/396 |
| 3,725,840 | 4/1973 | Hesse | 339/88 R |
| 4,241,969 | 12/1980 | D'Amato | 339/88 R |

*Primary Examiner*—John McQuade

*Attorney, Agent, or Firm*—H. Duane Switzer

[57] ABSTRACT

A locking device for interfitting connector members, particularly an electrical plug and receptacle/connector, for automatically locking the members in an axially interconnected relationship. The members include interfitting cylindrical male and female portions with the female portion having a plurality of integral leaf springs spaced apart from each other around the interior surface thereof. In addition, this interior surface includes a plurality of spaced apart locking tabs. The outer surface of the male portion includes a plurality of spring activating grooves and a plurality of locking tab receiver grooves at circumferentially spaced locations therearound adapted to cooperatively register with the leaf springs and locking tabs, respectively. As the male portion is axially received by the female portion, activating means associated with the activating grooves cause the leaf springs to be moved from a normal condition to a biasing condition tending to coaxially rotate the male and female portions relative to each other. When a predetermined axial relationship between the male and female portions is reached, the locking tabs enter tab locking zones associated with the tab receiver grooves as a result of limited relative rotation between the portions under the influence of the leaf springs. The tab locking zones cooperate with the locking tabs for retaining the male and female portions in a desired interconnected relationship.

30 Claims, 20 Drawing Figures

LOCKING DEVICE FOR INTERFITTING MEMBERS

BACKGROUND OF THE INVENTION

This invention pertains to the art of connectors and, more particularly, to connectors of the type wherein connector bodies having cooperating male and female portions are locked together in some predetermined axial relationship.

The invention is particularly applicable to electrical connectors and will be described with particular reference thereto. However, it will be appreciated by those skilled in the art that the invention has far broader applications and may be used in many other environments and for other types of connector constructions.

In many electrical connectors, male and female connector members are advantageously employed with a portion of the male connector being closely received in the female connector at assembly. One of the connector members typically includes prongs or the like receivable in corresponding openings in the other connector member to effect an electrical interconnection therebetween as is conventional. Because of the interfitting relationship between the prongs and receiving openings, the male and female connector members are placed in a cooperative or assembled relationship by an axial motion. In some cases, no additional retaining or locking means is provided between the two connector members.

However, in many installations, it is desired to lockingly retain the male and female members in the assembled condition to prevent inadvertent disruption of the electrical interconnection. Heretofore, many and varied devices or arrangements have been utilized to obtain such locking capabilities. While some of the prior locking devices have been rather complex or intricate in construction, others have been rather simple in nature. One of the more prevalent types of locking devices is the so-called bayonet fitting where one of the male and female connector members includes one or more locking tabs received in one or more axial receiving grooves disposed in the other connector member. When the male connector member has been axially inserted into the female connector member to some predetermined length, the members may be rotated relative to each other in order that the locking tabs are moved to locking areas included in the receiving grooves. These arrangements thus prevent inadvertent axial disassembly of the connector members. Moreover, it is also common to include axial biasing means between the male and female connector members for continuously urging the locking tabs into a retained or locked position in the receiving groove locking areas.

While the foregoing general type of connector construction has found wide commercial acceptance, they do suffer an inherent drawback. That is, the male and female connector members are not automatically moved to a locked condition when a predetermined length of the male member is axially received by the female member. As a result, and unless a positive turning action is effected between the two members, it is possible to inadvertently cause disassociation therebetween. The potential for this occurrence is particularly undesirable in, for example, applications where an uninterrupted electrical supply is necessary or where the connector is not easily accessible.

Because of the foregoing difficulties, it has been considered desirable to develop an automatic locking arrangement for interfitting male and female members. The subject invention provides such a device which overcomes these problems and others. The invention is relatively simple in design, easy to use, versatile, and adapted to a wide range of environments or applications.

BRIEF DESCRIPTION OF THE INVENTION

The subject new device advantageously provides automatic locking for cooperating male and female members disposed in an axially interconnected relationship. The device causes automatic relative rotation between the male and female members to a locked condition when a predetermined amount of the male member has been received by the female member.

More particularly in accordance with the invention, at least a first generally cylindrical male portion at a first terminal end of a first member is axially receivable in a generally cylindrical female portion of a second member from a second terminal end. One of the male and female portions includes biasing means cooperable with activating means on the other of the male and female portions as the male portion is axially received by the female portion. This activating means causes the biasing means to be moved from a first normal position toward a second biasing position wherein the biasing means exerts a force tending to relatively rotate the male and female portions coaxially of each other. Locking means cooperable between the male and female portions is selectively movable between first non-locking and second locking conditions. The locking means is automatically moved to the second condition when a predetermined length of the male portion is axially received in the female portion and the male and female portions have been relatively rotated under the influence of the biasing means.

In accordance with another aspect of the invention, the activating means comprises an activating groove extending generally axially of the other portion from the terminal end thereof for receiving the biasing means. The activating groove includes an activating area engagable with the biasing means for moving the biasing means toward the biasing position as the male portion is axially received by the female portion. In one arrangement, the activating area includes the side wall of the activating groove. In another arrangement, the activating area comprises a cam on the activating groove bottom wall.

According to another aspect of the invention, the biasing means comprises an elongated spring member disposed adjacent the terminal end of the one portion and extending generally axially thereof. In the preferred arrangement, the spring member has one end affixed to the one portion and another free end spaced from the one end.

In accordance with a further aspect of the invention, the spring member is integral with the one portion. In the preferred construction, a plurality of spring members are provided at circumferentially spaced intervals around the one portion. Also, a plurality of activating grooves are provided in the other portion and are located for cooperative registry with the spring members.

According to yet another aspect of the invention, the locking means is comprised of a locking tab on one of the male and female portions and a tab receiver on the other of the male and female portions. The tab receiver includes an axial tab entry zone extending from the other portion terminal end thereof and a tab locking zone communicating with the entry zone. The locking tab is automatically moved into the locking zone when the male and female portions are disposed in a desired axial relationship.

In accordance with still another aspect of the invention, the tab entry zone tapers from a maximum width at the other portion terminal end to a minimum width adjacent the locking zone. The locking zone itself extends circumferentially of the other portion and includes a locking surface cooperable with the locking tab. In the preferred construction, the locking tab comprises a radial protrusion on the one portion and the tab receiver comprises a groove-like area in the other portion. Also, at least a pair of locking tabs and a pair of tab receivers are preferably utilized.

In the preferred embodiment of the subject new device, one of the male and female portions comprises an electrical plug and the other portion comprises a receptacle/connector. The female portion includes the spring members and locking tabs associated with the interior side wall thereof with the male portion, in turn, including the spring activating grooves and locking tab receiver grooves. Both the male and female portions are molded from a plastic material in order that at least the spring members and locking tabs may be integrally formed with the associated one of the male and female portions.

The principal object of the present invention is the provision of a new automatic locking device for axially interconnected male and female members.

Another object of the invention is the provision of such a device which is simple in design and effective to use.

Another object of the invention is the provision of an automatic locking device for retaining an electrical plug and receptacle/connector in an interconnected relationship with each other.

A still further object of the invention is the provision of a new automatic locking device which is readily adapted to use in different environments or applications and on any number of different male and female connector members cooperatively interconnected by having the male member axially received by the female member.

Still other objects and advantages for the invention will become apparent to those skilled in the art upon a reading and understanding of the following detailed specification.

BRIEF DESCRIPTION OF THE DRAWINGS

The invention may take physical form in certain parts and arrangement of parts, preferred and alternative embodiments of which will be described in detail in this specification and illustrated in the accompanying drawings which form a part hereof and wherein.

DETAILED DESCRIPTION OF THE PREFERRED AND ALTERNATIVE EMBODIMENTS

Figure 1:
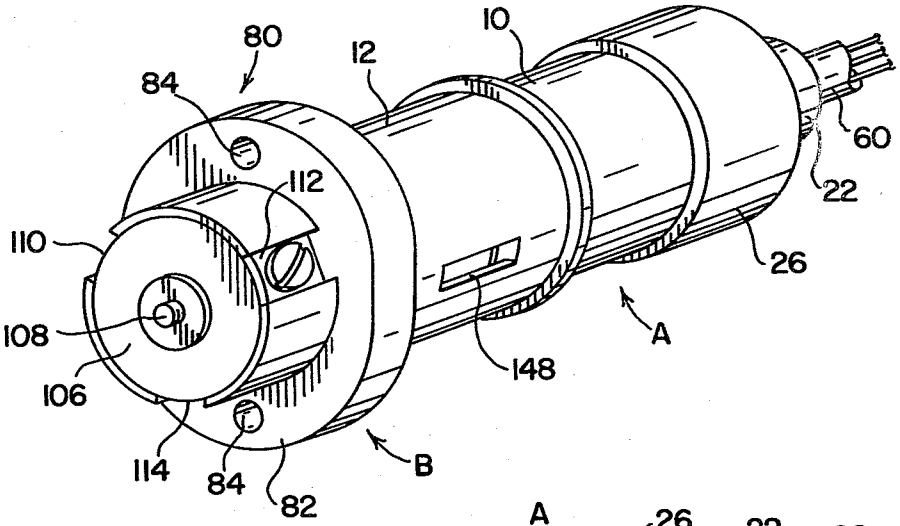
FIG. 1 is a perspective view of an electrical connector comprised of interconnected male and female members which incorporate the automatic locking device of the subject invention thereinto.
Figure 2:
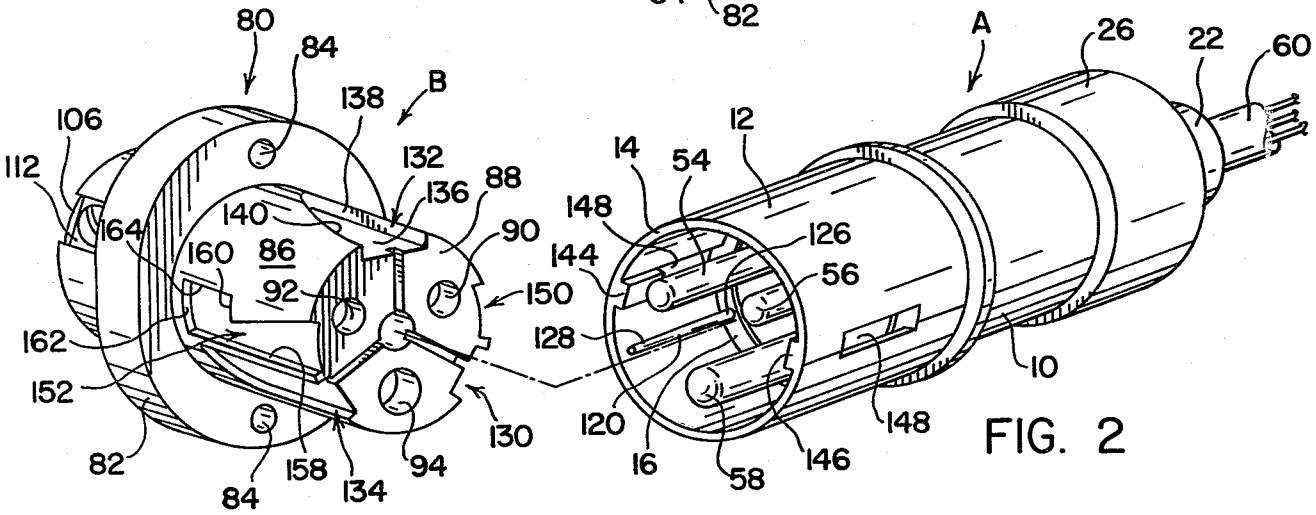
FIG. 2 is a perspective view of the connector of FIG. 1 showing the male and female connector members in a separated relationship for better showing the new locking device.

Referring now to the drawings wherein the showings are for purposes of illustrating preferred and alternative embodiments of the invention only and not for purposes of limiting same, FIGS. 1 and 2 show an electrical connector arrangement comprised of a plug member A and a receptacle/connector B. FIG. 1 shows the plug and receptacle/connector in an interconnected relationship with FIG. 2 showing the plug and receptacle/connector in a disconnected relationship. It will be appreciated that the electrical conductor shown in these FIGURES is exemplary and that the new locking device may be incorporated into other types of connectors, both electrical and non-electrical.

In the electrical plug and receptacle industry in which the preferred and alternative embodiments of the invention are shown and described, the plug is normally referred to as the male member and the receptacle is normally referred to as the female member. However, and as used hereinafter, the terms male and female members are employed to designate a relative relationship between two cooperative structures without regard as to which structure defines or includes the plug or which structure defines or includes the receptacle.

More particularly, and with reference to FIGS. 1-5, plug A includes a hollow, generally cylindrical outer casing or housing 10 having a cylindrical female portion 12 at one end area thereof terminating in a terminal end 14. Disposed axially inward from terminal end 14 is a radial inward shoulder 16 extending substantially circumferentially of outer casing 10. A generally cylindrical terminal block 18 is closely received in the outer casing and locatingly engages shoulder 16 adjacent the forward end thereof. An end piece 20 is received in the outer casing at the other end of terminal block 18 and includes a hollow cylindrical extension 22 extending outwardly therefrom. In addition, a locating shoulder 24 extends circumferentially of the end piece and engages the outer end face of outer casing 10. An end cap 26 having a generally centrally disposed opening 28 extending therethrough to accommodate extension 22 is threadedly secured to the outer casing as at threaded area 30 for retaining terminal block 18 and end piece 20 in a located relationship within the outer casing.

Figure 3:
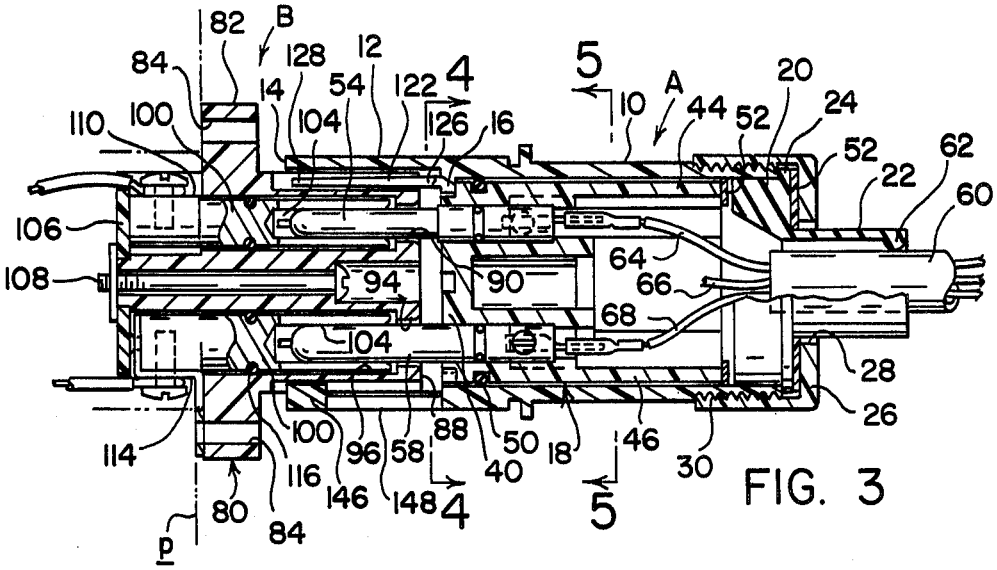
FIG. 3 is a generally longitudinal cross-sectional view of the connector shown in FIG. 1.
Figure 4:
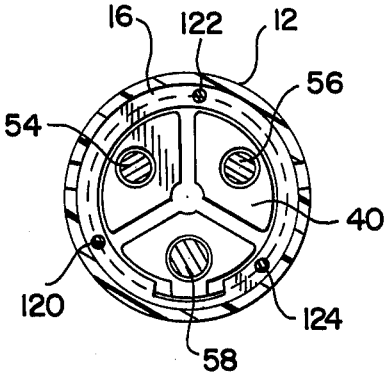
FIG. 4 is a cross-sectional view taken generally along lines 4—4 in FIG. 3.
Figure 5:
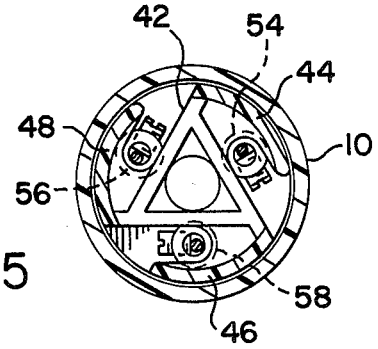
FIG. 5 is a cross-sectional view taken generally along lines 5—5 in FIG. 3.

More particularly, and with primary reference to FIGS. 3, 4, and 5, terminal block 18 includes a terminal portion 40 and a frame portion 42 having the conformation of a generally equilateral triangle. Support legs 44,46 and 48 are associated with terminal and frame portions 40, 42 at areas thereof which generally comprise extensions of the frame portion legs. Support legs 44,46 and 48 are elongated and extend axially of terminal block 18 from the rear of terminal and frame portions 40,42. As shown in FIG. 5, each support leg is curved over its width dimension with such curvature substantially conforming to the internal curvature of casing 10. An elastomeric O-ring or gasket 50 is received in a groove extending circumferentially of terminal portion 40 and engages the internal side wall of the outer casing. In addition, a plastic washer 52 is interposed between the rear end face areas of support legs 44, 46 and 48 and the forward end face of end piece 20. The dimensioning between terminal block 18 and outer casing 10 is such that at least some limited rotational movement between these two components is permitted to facilitate the interconnection between plug A and receptacle/connector B in a manner to be described.

Elongated electrically conductive prongs 54,56,58 are received in openings extending axially of terminal portion 40 and extend outwardly from the forward end face of the terminal portion. The plug A herein described comprises a conventional 3-prong type plug with prong 58 comprising the ground connection. As best shown in FIG. 4, these prongs are generally equidistantly spaced apart from each other around terminal portion 40. As shown in FIG. 3, the prongs extend axially outward from the terminal portion so that the plug outermost ends are disposed generally at or inwardly adjacent terminal end 14 of outer casing 10. An electrical cable 60 extends through hollow extension 22 of end piece 20 and a radial inward protrusion 62 engages the outer covering or insulation of cable 60. This protrusion aids in retaining the cable in position relative to plug A and in preventing any tension forces applied thereto from adversely affecting the connected relationship between the individual electrical wires 64,66,68 which comprise cable 60 and the associated constructive prongs 54,56,58. Leads or wires 64,66,68 are connected to prongs 54,56,58 by conventional connectors as is known in the art.

Referring now to FIGS. 1, 2, and 3, receptacle/connector B is comprised of a body 80 which includes a radial mounting flange extending exteriorly therearound between the opposed ends thereof. Flange 82 includes a pair of mounting openings or the like 84 which facilitate convenient mounting of the receptacle/connector to a wall, panel or the like p as shown in the phantom line of FIG. 3. Body 80 includes a first male portion 86 having a generally cylindrical conformation dimensioned to be closely received in female receiving portion 12 of outer casing 10 (FIG. 3). First portion 86 terminates in an outer end face 88 and this end face includes openings 90,92,94 penetrating therethrough and extending axially of body 80. The openings are generally equidistantly spaced apart from each other in a manner to register with and receive prongs 54,56,58 when the plug and receptacle are placed in an interconnected relationship.

Openings 90,92,94 have a cross-sectional dimension slightly greater than the associated prong and, as best seen in FIG. 3, each opens into a somewhat larger chamber area 96 adjacent body end face 88. Each chamber area receives an elongated electrically conductive prong receiving member 100 having a cylindrical body and a slotted prong receiving opening 104 in the forward end thereof. These receiving openings are dimensioned so as to closely engagingly receive prongs 54,56,58. The slotted arrangement allows slight radial expansion to accommodate prong receipt while maintaining the desired prong engagement as is known in the art.

The forward end face of chamber area 96 acts to retain prong receiving members 100 in position adjacent body end face 88 and an end plate 106 retains the prong receiving members in chamber areas 96 at the other end of body 80. This end plate is conveniently secured to the receptacle body by means of an elongated threaded fastener 108 extending generally coaxially therethrough. Conventional connector areas 110,112,114 are provided on the other side of body flange 82 from first portion 86 for allowing electrical leads to be secured in conducting communication with prong receiving members 100 by conventionally used means such as threaded fasteners or the like. An elastomeric gasket or O-ring 116 is disposed in a surrounding relationship with each prong receiving member 100 in a contacting relationship with the side wall of the associated chamber area 96 to aid in sealing the assembly.

The foregoing description with reference to plug A and receptacle/connector B of FIGS. 1–5 represents only one type or conformation of electrical connector construction with which the subject invention may be advantageously employed. It will be readily appreciated that there are many other types, styles, and variations of electrical connectors available; however, the subject invention is deemed equally applicable with such other constructions and the foregoing description is merely by way of example only. Moreover, at least outer case 10, terminal block 18, and body 80 are constructed or formed from an electrically insulating material as is conventional. In the preferred arrangement, a molded plastic construction for these components is preferred for reasons which will become apparent.

Figure 6A:
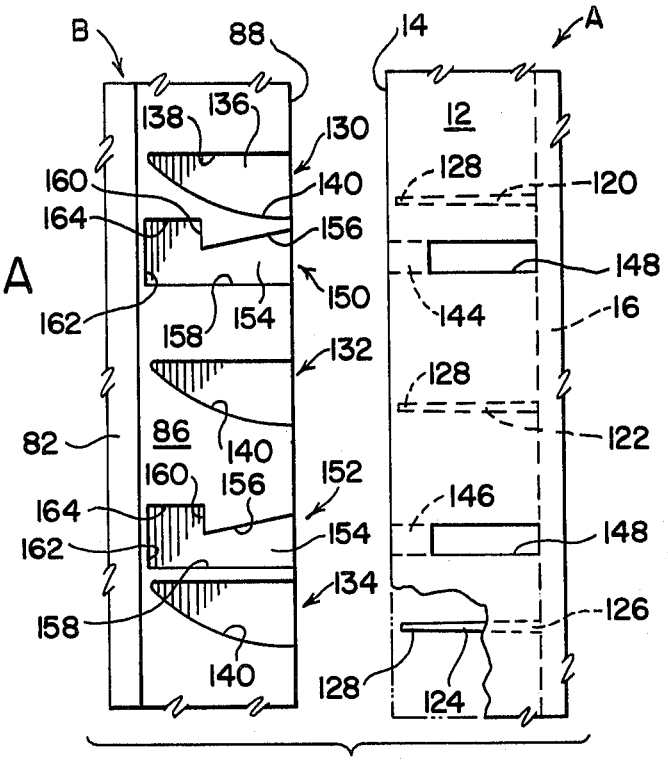
FIGS. 6A, 6B, and 6C are projected plan views in partial cross-section of the interfitting male and female portions of the connector member for progressively showing operation of the subject new automatic locking device.
Figure 6B:
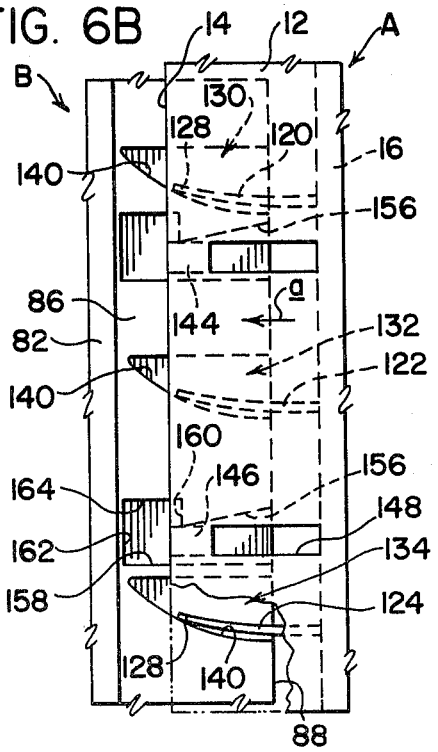
Figure 6C:
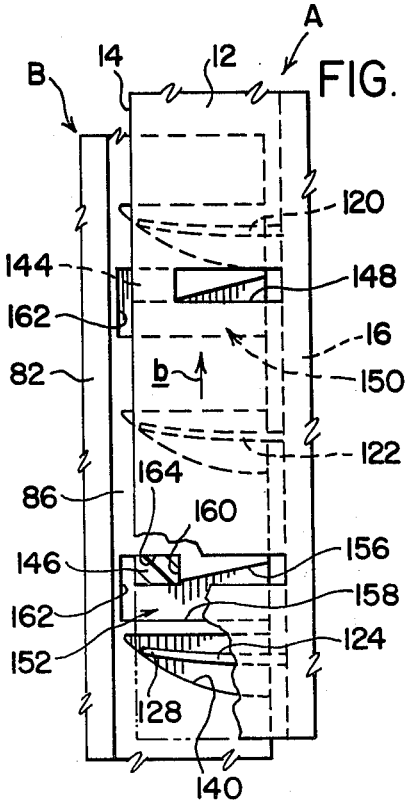

With primary reference to FIGS. 6A, 6B, and 6C and with secondary reference to FIGS. 1–5, outer casing 10 includes three leaf springs 120,122,124. These leaf springs each extend axially of the outer casing from a fixed end 126 to an outer free end 128 spaced inwardly adjacent receiving portion terminal end 14. The body of each of leaf springs 120,122,124 is laterally spaced a short distance from the interior wall of receiving portion 12 (FIG. 4). In the preferred construction of the present invention, these springs are integrally molded or formed with the outer casing and are generally equidistantly spaced apart from each other circumferentially of shoulder 16.

Leaf springs 120,122,124 are moved from a first normal position as shown in FIG. 6A to a second biasing position by spring activating means which comprise activating grooves 130,132,134 extending generally axially in receptacle body first portion 86 from outer end face 88 thereof. Each of these activating grooves includes a bottom wall 136 and a pair of side walls 138,140. As best shown in FIG. 6A, side wall 140 has an arcuate conformation over its length dimension from end face 88 where it is laterally spaced from side wall 136 to a point spaced axially inward from face 88 where it merges into side wall 138. Side wall 140 thus provides a cam-type of surface for moving the associated leaf springs into a biasing condition in a manner to be described. Grooves 130,132,134 are generally equidistantly spaced apart from each other circumferentially around body first portion 86 in a manner allowing springs 120,122,124 to register therewith and engage surfaces 140 thereof when first male portion 86 is inserted into female receiving portion 12.

In order to lock plug A and receptacle/connector B in an axially interconnected relationship, a pair of locking tabs 144,146 as shown in FIG. 6A are advantageously provided on female receiving portion 12. In the preferred arrangement shown, these locking tabs comprise generally rectangular protrusions extending radially inward a short distance from the interior surface of the receiving position (FIG. 2). These tabs are generally oppositely disposed from each other on the receiving portion and a through groove 148 communicates between the axial inner end of each tab and shoulder 16. Tabs 144,146 are also advantageously integrally molded with outer casing 10.

Body 80 includes a pair of receiver grooves 150,152 extending generally axially of first portion 86 from end face 88. These grooves are generally oppositely disposed from each other around first portion 88 to facilitate registry with locking tabs 144,146 when plug A is interconnected with receptacle/connector B. Each receiver groove includes a bottom wall 154 and a pair of spaced apart side walls 156,158 to define a tab entry zone. Side wall 156 tapers toward side wall 158 so that the entry zone has a maximum width at body end face 88 and a minimum width axially spaced therefrom. A tab locking zone defines a pair of side walls 160,162 and an end wall 164 communicates with the entry zone at the axially innermost end of the locking zone. As will best be noted from FIGS. 2 and 6A, the locking zone portion of receiver grooves 150,152 extend circumferentially of body first portion 86, that is, generally normal to the entry zones.

Side wall 160 of each receiver groove 150,152 defines a tab locking surface which prevents axial disassociation of plug A and receptacle/connector B when these two components are disposed in a locked relationship with each other. Surfaces 160 are laterally spaced from end face 88 so that when locking tabs 144,146 are disposed in a locked position, prongs 54,56,58 are received to a desired length in prong receiving openings 104 of prong receiving members 100 with body end face 88 having a desired spacial relationship with the face of terminal block terminal portion 40. In some cases, this relationship may be a contacting one as between these two faces, although as shown in FIG. 3, end face 88 and the end face of terminal portion 40 are laterally spaced a short distance from each other.

Referring to FIG. 2, and in order to interconnect plug A with receptacle/connector B, it is first necessary to orient the two components so that prongs 54,56,58 are generally aligned with openings 90,92,94, respectively. In this condition, and with additional reference to FIG. 6A, leaf springs 120,122,124 will be generally aligned with activating grooves 130,132,134, respectively, and locking tabs 144,146 will be generally aligned with receiver grooves 150,152, respectively. Thereafter, and as shown in FIG. 6B, plug A is moved in the direction indicated by arrow a so that male portion 86 on receptacle/connector B is received in the female receiving portion 12 of plug A. During movement in direction a, outer free ends 128 of the leaf springs engage side wall 140 of the associated activating grooves 130,132,134. Upon such engagement, the leaf springs are arcuately bent over their lengths around the fixed ends 126 thereof. At the same time, locking tabs 144,146 are moving axially through the entry zones defined between side walls 156,158 of receiver grooves 150,152. The orientation between the locking tabs and entry zones is such that tabs 144,146 will ride against tapered side wall 156 of the associated receiver groove 150,152. The tapered relationship between side walls 156,158 allows for some slight misalignment at the initial stages of the insertion process and thereafter rectifies any such misalignment. At the same time, the cooperative relationship between locking tabs 144,146 and side walls 156 causes a slight rotation between plug A and receptacle/connector B so that leaf springs 120,122,124 are moved into camming engagement with side walls 140 for deflecting the leaf springs toward the biased position as shown in FIG. 6B.

Relative movement between the plug and receptacle/connector continues in direction a until locking tabs 144,146 pass entirely from the entry zones into the locking zones of receiver grooves 150,152. At that juncture, and as shown in FIG. 6C, the biasing force of leaf springs 120,122,124 automatically causes relative rotation between plug A and receptacle/connector B so that each of locking tabs 144,146 will enter its respective locking zone as defined between side walls 160,162 of the associated one of receiver grooves 150,152. End walls 164 limit the amount or degree of such rotation and side walls 160, acting as tab locking surfaces, prevent axial displacement of the plug and receptacle/connector. Side walls 162 may act as stop-like areas for tabs 144,146 to limit the amount of male portion 86 received by female receiving portion 12. During the foregoing relative rotation between the plug and receptacle/connector, and since prongs 54,56,58 will be received by body openings 90,92,94 (FIG. 2), terminal block 18 will remain stationary. That is, outer casing 10 will be coaxially rotated a short distance relative to terminal block 18. Such limited rotation is accomodated by the overall construction of the receptacle/connector as described in detail above.

In the condition shown in FIG. 6C, the leaf springs are retained in a biasing condition for continuously maintaining the plug and receptacle/connector in a locked relationship. This then prevents inadvertent or accidental axial disassociation of the plug and receptacle/connector. Again, as locking tabs 144,146 approach the locking zones of receiver grooves 150,152 respectively during the insertion step, relative rotation between plug A and receptacle/connector B is automatically effected by the leaf springs to place the two connector members in a locked relationship with each other. When it is desired to disconnect the plug from the receptacle/connector, it is merely necessary to rotate the two members relative to each other against the force of leaf springs 120,122,124 and then axially separate the two members from each other.

FIGS. 7, 8, 9A, 9B, and 9C show one alternative embodiment which utilizes the broad concepts of subject invention. For ease of illustration and appreciation of this alternative, like components are identified by like numerals with a primed (') suffix and new components are identified by new numerals.

Figure 7:
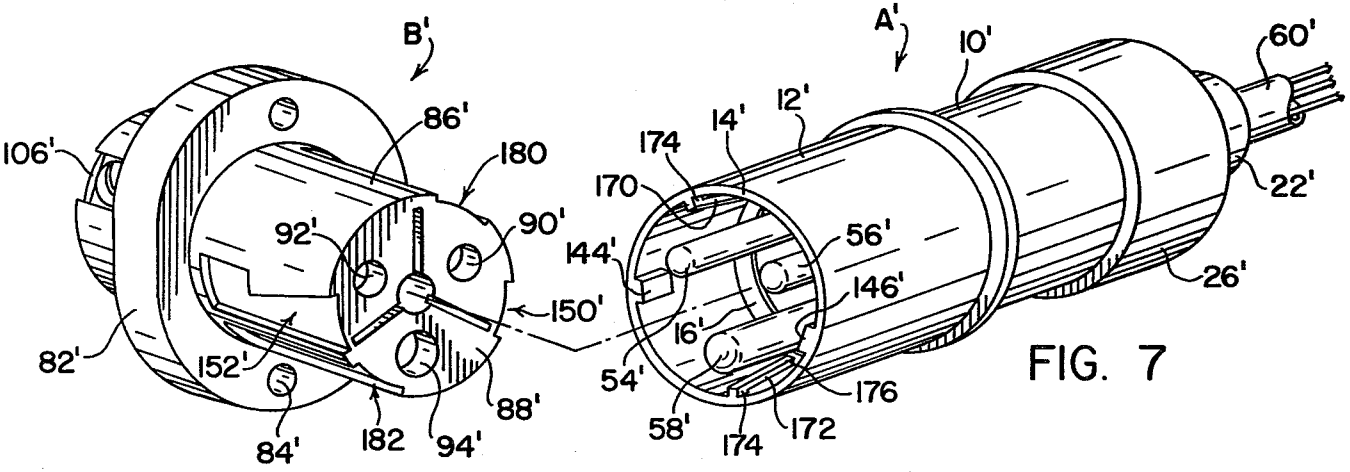
FIG. 7 is a perspective view similar to FIG. 2 showing one alternative embodiment of the automatic locking device.
Figure 8:
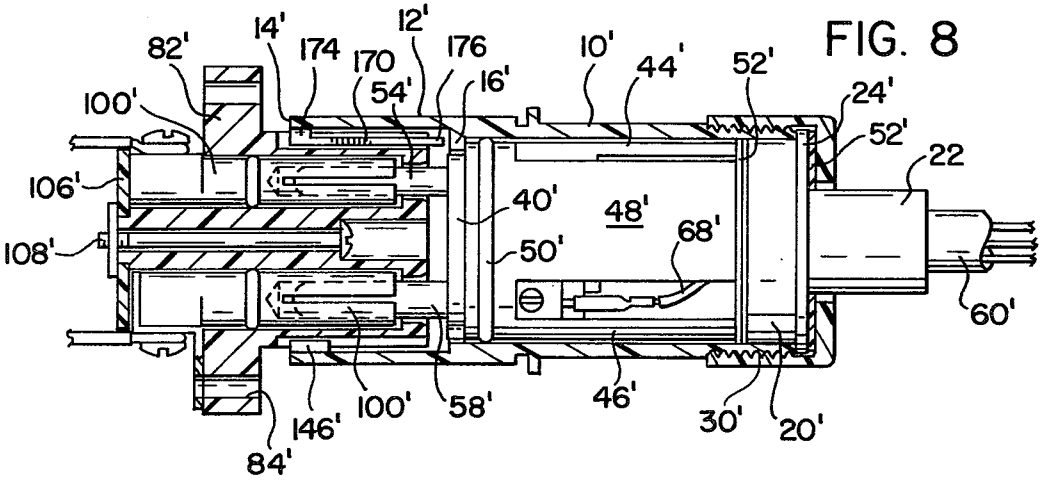
FIG. 8 is an assembled view of the connector shown in FIG. 7 in partial cross-section for ease of illustration.
Figure 9A:
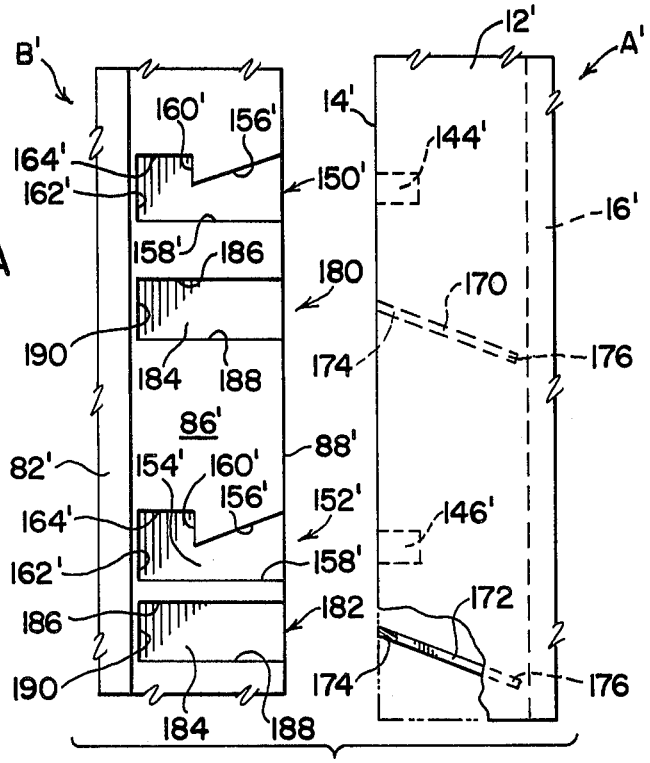
FIGS. 9A, 9B, and 9C are projected plan views in partial cross-section of the interfitting male and female portions of the connector members for progressively showing operation of the alternative locking device embodiment in FIG. 7.

Referring to FIGS. 7 and 8, the overall connector construction is substantially identical to that hereinabove previously described. The only significant modifications thereto reside in the areas of the biasing and activating means. More particularly, this alternative embodiment employs a pair of elongated leaf springs 170,172 with each having a first end 174 fixedly associated with the interior surface of female receiving portion 12' adjacent terminal end 14' thereof. Preferably, these leaf springs are integrally formed with outer housing 10'. A free end 176 of each spring is spaced generally axially inward into receiving portion 12' adjacent shoulder 16'. As best shown in FIG. 9A, however, leaf springs 170,172 are also canted slightly relative to the longitudinal axis of plug A between first and free ends 174,176. Because of this conformation, the springs are slightly further spaced from the interior surface of female receiving portion 12' adjacent free end 176 than at end 174. This arrangement allows the spring members to be moved from a normal position to a biasing position in a manner to be described without interfering engagement with the interior of receiving portion 12'.

The spring activating means in this embodiment again comprises activating grooves with such grooves being designated by numerals 180,182. Each groove, in turn, includes a bottom wall 184 and a pair of parallel spaced apart side walls 186,188 which extend axially in first portion 86' from end face 88' and terminate at an inner end wall 190. Because of the conformation of leaf springs 170,172, the corner area of groove side walls 188 at end face 88' acts as the actual activating means in a manner to be described.

In this embodiment, only a pair of leaf springs and activating grooves are employed, although other numbers thereof could be utilized if so desired. Also, locking tabs 144',146' and locking tab receiver grooves 150',152' are substantially identical to those hereinabove previously described. The function and cooperation between the tabs and receiver grooves are also substantially identical to those already described.

Figure 9B:
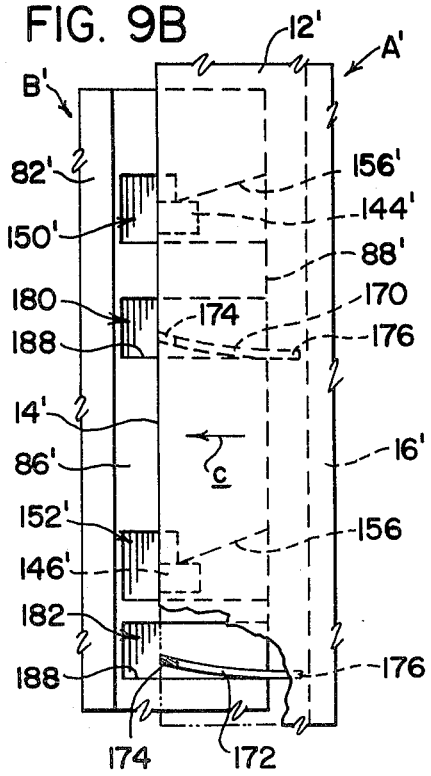
Figure 9C:
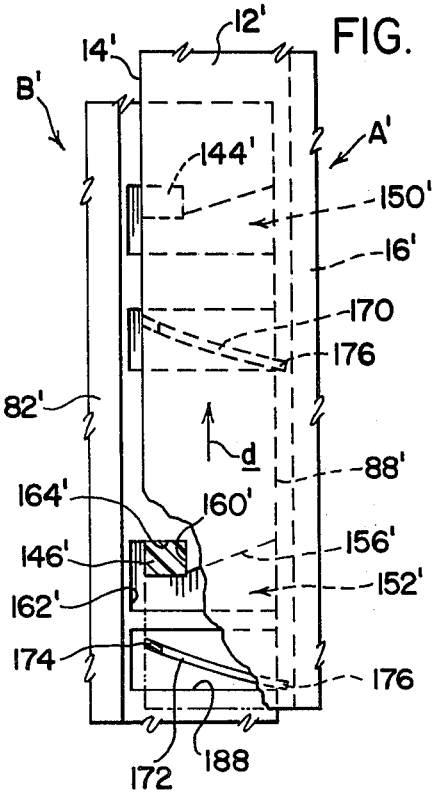

Referring now to FIG. 9A and with plug A' and receptacle/connector B' properly oriented and aligned, the components are axially moved so that the first male portion 86' of the receptacle/connector is closely received within receiving portion 12' of the plug in the manner shown in FIG. 9B. During relative axial movement of these two components in, for example, direction c of FIG. 9B, each leaf spring 170,172 will engage side wall 188 of the associated spring activating groove 180,182 at the area thereof generally adjacent end face 88'. Such action causes the leaf springs to be moved from the first normal condition shown in FIG. 9A toward a second biasing condition causing a positive rotation of the plug and receptacle/connector relative to each other.

Rotation is, however, prevented by the interaction of locking tabs 144',146' with side walls 156' of the associated receiver groove 150',152'. Once the plug and receptacle/connector have reached the position shown in FIG. 9C, the components are free to rotate relative to each other with each locking tab 144',146' being received in the locking zone portion of the associated receiver groove 150',152' as previously described. Such relative rotation is designated by the arrow d in FIG. 9C and as there shown, leaf springs 170,172 are still partially stressed in order to retain the components in a locked relationship.

Still another alternative construction is shown in FIGS. 10, 11, 12A, 12B, 12C, 13, and 14. Here, like components are identified by like numerals with a double primed (") suffix and new components are identified by new numerals. Here too, the only significant difference involved resides in the arrangement of the biasing and activating means.

In this embodiment, a pair of leaf springs 200,202 have one end 204 secured to the interior surface of female receiving portion 12" and extend generally axially inward thereof to a free end 206 located adjacent shoulder 16". Here, the width of leaf springs 200,202 is slightly greater than the widths of the springs employed in the previously described embodiments to function as cam followers in a manner to be described. In addition, leaf springs 200,202 taper slightly radially inward over their respective lengths from ends 204 to free ends 206.

Figure 10:
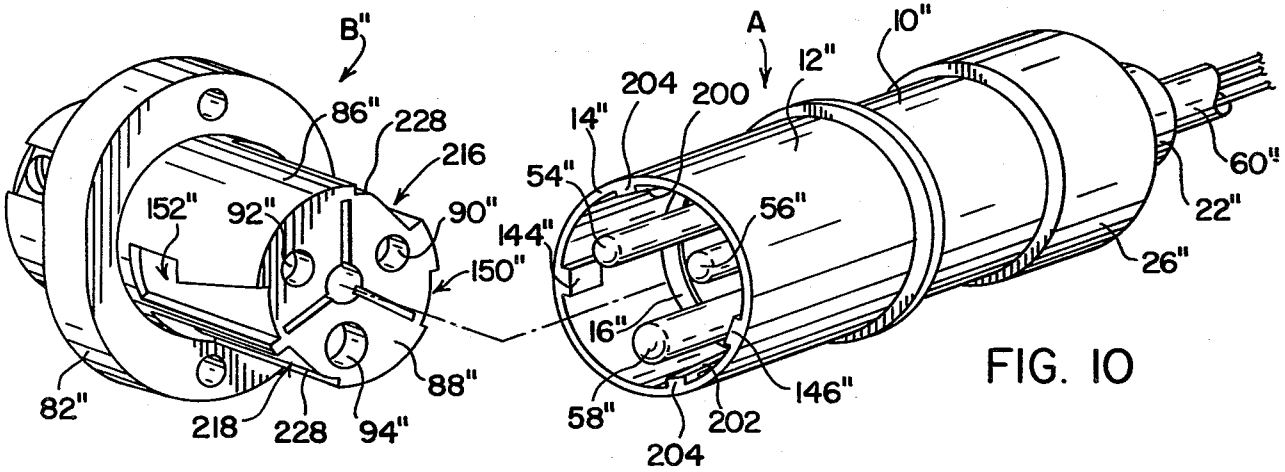
FIG. 10 is a view similar to FIG. 2 showing another alternative embodiment of the automatic locking device.
Figure 11:
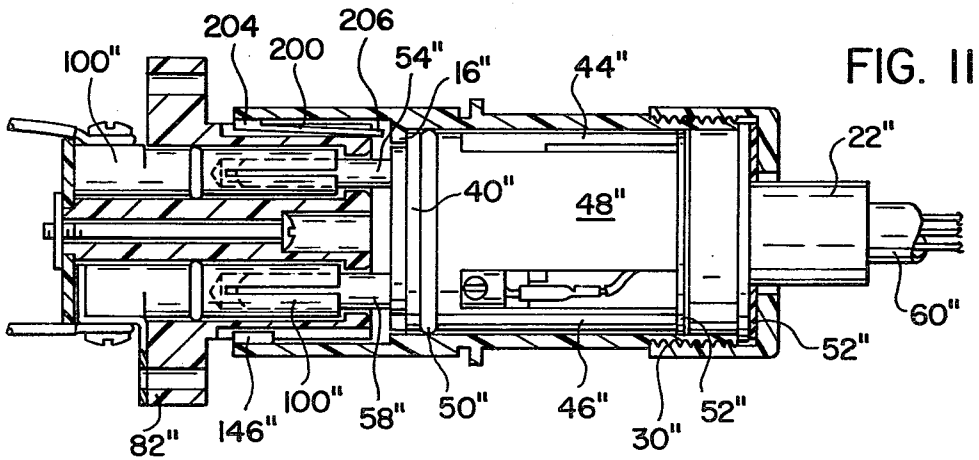
FIG. 11 is an assembled view of the connector shown in FIG. 10 in partial cross-section for ease of illustration.
Figure 13:
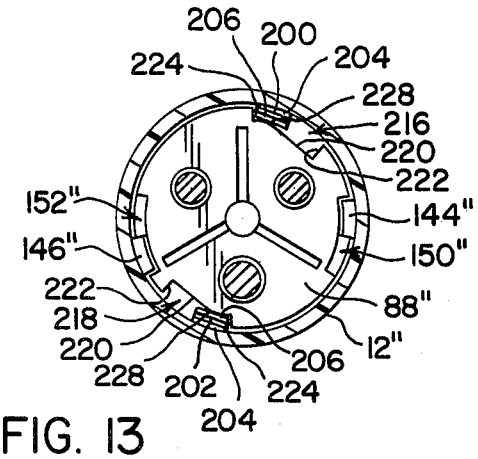
FIG. 13 is a cross-sectional view taken generally along lines 13—13 of FIG. 12B; and, FIG. 14 is a cross-sectional view taken generally along lines 14—14 of FIG. 12C.
Figure 14:
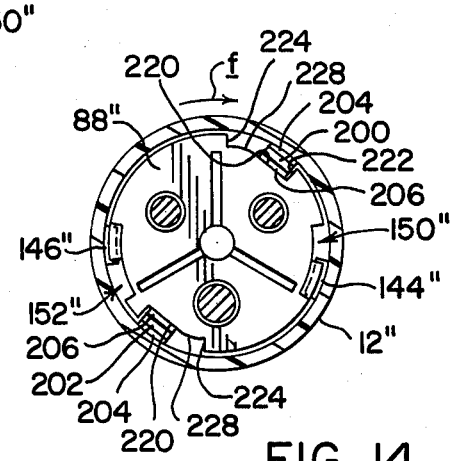

Also in this embodiment, the spring activating means comprises activating grooves 216,218 disposed in the exterior surface of first male portion 86" to extend axially from end face 88" thereof. The activating grooves are identical to each other and each includes a bottom wall 220, a pair of parallel spaced apart side walls 222,224, and an end wall 226. Each bottom wall 220 is configured so as to define an axial cam lobe 228 generally adjacent the area of the associated side wall 224. The conformation of bottom walls 220 for defining lobes 228 is best shown in FIGS. 10, 13, and 14. Each cam lobe cooperates with the associated one of leaf springs 200,202 to cause a desired biasing action in a manner to be described.

Figure 12A:
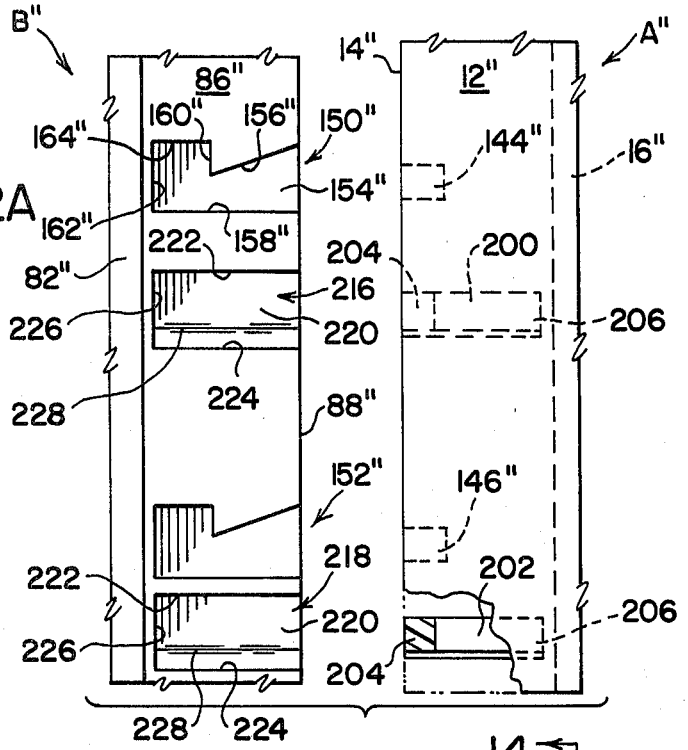
FIGS. 12A, 12B, and 12C are projected plan views in partial cross-section of the interfitting male and female portions of the connector members for progressively showing operation of the alternative locking device embodiment of FIG. 10.
Figure 12B:
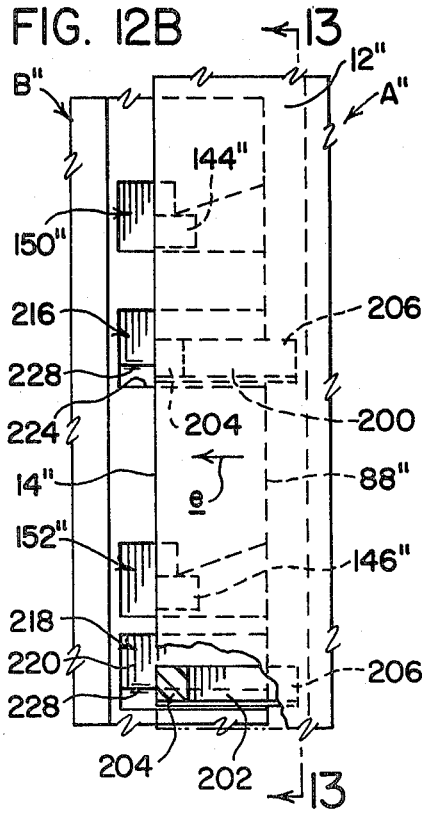
Figure 12C:
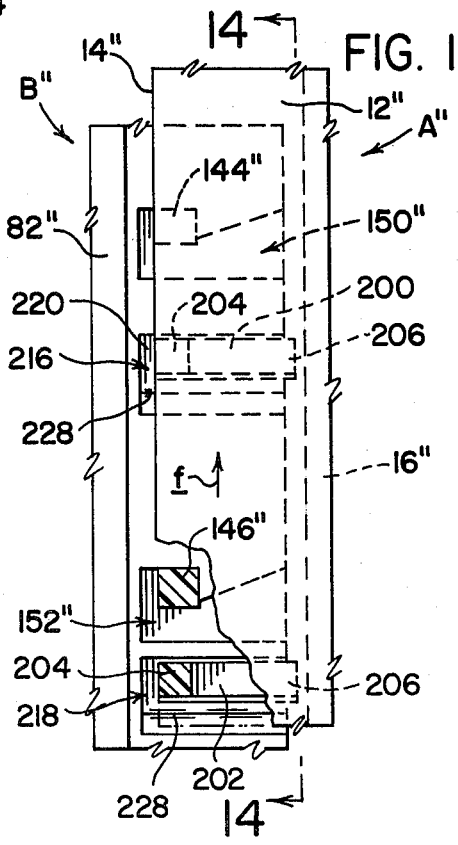

Referring to FIGS. 12A, 12B, and 12C, FIG. 12A shows plug A" and receptacle/connector B" in an aligned condition prior to the time first male portion 86" is received by female receiver 12". As the insertion is made in direction e of FIG. 12B, locking tabs 144",146" pass axially along receiver grooves 150",152", respectively. At the same time, leaf springs 200,202 pass into activating grooves 216,218, respectively. Because of their radial inward taper, the inner surface of each spring 200,202 will physically engage bottom wall 220 of the associated activating groove at the area of cam lobe 228. Such physical engagement occurs at least by the time the insertion process has reached the stage shown in FIG. 12B. Once an engaging position has been realized, further insertion causes the leaf springs to be biased radially outward at free ends 206 by cam lobes 228 to, in effect, move the springs from a first normal condition toward a second biasing condition.

The cam lobes are positioned and configured so that when in the biasing condition, leaf springs 200,202 tend to rotate plug A" and receptacle/connector B" relative to each other. The cross-sectional view of FIG. 13 best shows this particular cooperative arrangement. As the insertion process continues to the position of FIG. 12C, the biasing force of the leaf springs against cam lobes 228 causes relative rotation between the plug and receptacle/connector in the direction generally designated by arrow f in FIG. 12C. Such rotation, in turn, causes locking tabs 144",146" to enter into locking engagement with the locking zones of receiver grooves 150″,152″, as already described.

When the locking tabs are rotated into the locking zones, leaf springs 200,202 remain in biasing engagement with bottom walls 220 of the activating grooves 216,218 for retaining the locked condition. As will be best seen from the cross-sectional view of FIG. 14, and after the plug and the receptacle/connector have been relatively rotated in direction f to a locked condition, leaf springs 200,202 are disposed in engagement with a generally flat or planar portion of activating groove bottom walls 200 extending laterally between lobes 228 and side walls 222. Such engagement tends to retain the plug and receptacle/connector in an interconnected relationship.

The preferred and alternative embodiments which have been described in detail facilitate automatic locking of a male member within a female member once the two members have been placed in some predetermined axial relationship with each other. In order to disconnect the two members, it is merely necessary to relatively rotate them against the urging of the biasing means until the locking tabs are moved out of the locking position. Thereafter, the male and female members may be axially withdrawn from each other. The automatic locking feature is highly desirable in that it prevents inadvertent or accidental disassociation of the male and female members from each other. This capability is particularly significant in the preferred environment of use for the device, that is, electrical connectors, since it assures that a locking relationship is achieved and thereafter maintained.

While the subject new invention has been described with reference to use in electrical connectors, it will be appreciated that the basic concept involved is readily adapted to use in many other environments and/or types of male and female connectors. Such other applications would include mechanical cable connectors, hose couplings, fiber optic connectors, and the like where it may be desired to automatically lock a pair of male and female members in an axially interconnected relationship. Moreover, and while the biasing means and locking tabs of the subject invention have been described with reference to including them on the interior surface of a female receiving portion, it will be appreciated that they could be incorporated into the male portion or into combinations of the male and female portions as desired or necessary to accommodate particular circumstances.

The invention has been described with reference to preferred and alternative embodiments. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A device for automatically locking cooperative first and second members in an axially interconnected relationship, at least a generally cylindrical male portion of said first member from a first terminal end being axially receivable in a generally cylindrical female portion of said second member from a second terminal end, said device comprising:

one of said male and female portions including a pluraity of spring members cooperable with a plurality of activating means on the other of said male and female portions, said spring members and said activating means being spaced apart circumferentially around the associated of said male and female portions, said spring members being placed in direct activating engagement with said activating means as said male portion is axially inserted into said female portion for causing said biasing means to be moved from a first normal position toward a second biasing position exerting a biasing force to urge relative rotation between said male and female portions; and, locking means cooperable between said male and female portions selectively movable from a first non-locking to a second locking condition, said locking means being automatically moved to said locking condition when a predetermined length of said male portion is received in said female portion and said male and female portions are relatively rotated under the influence of said biasing means.

2. The device as defined in claim 1 wherein said spring members are elongated and each is affixed at one end thereof to said one portion with a spring member free end spaced from said one end.

3. The device as defined in claim 1 wherein said activating means comprises a plurality of spring member receiving areas in said other portion for receiving an associated spring member when said male portion is received by said female portion, each receiving area including a spring member engaging portion for moving the associated spring member from said first normal position to said second biasing position.

4. A device for automatically locking cooperative first and second members in an axially interconnected relationship, at least a generally cylindrical male portion of said first member from a first terminal end being axially receivable in a generally cylindrical female portion of said second member from a second terminal end, said device comprising:

one of said male and female portions including biasing means cooperable with activating means on the other of said male and female portions as said male portion is axially received in said female portion, said activating means causing said biasing means to be moved from a first normal position toward a second biasing position exerting a biasing force to urge relative rotation between said male and female portions;

locking means cooperable between said male and female portions selectively movable from a first non-locking to a second locking condition, said locking means being automatically moved to said locking condition when a predetermined length of said male portion is received in said female portion and said male and female portions are relatively rotated under the influence of said biasing means; and, wherein said activating means comprises an activating groove extending generally axially of said other portion from the terminal end thereof for receiving said biasing means, said activating groove including an activating area engageable with said biasing means for moving said biasing means from said first position toward said second biasing position as said male portion is axially received by said female portion.

5. The device as defined in claim 4 wherein said activating groove includes a groove side wall with said groove side wall comprising said activating area.

6. The device as defined in claim 4 wherein said activating groove includes a groove bottom wall, said activating area comprising a cam surface in said bottom wall extending generally axially of said bottom wall.

7. The device as defined in claim 4 wherein said biasing means comprises an elongated spring member associated with said one portion and extending generally axially thereof.

8. The device as defined in claim 7 wherein said spring member is affixed adjacent one end to said one portion and includes a free end spaced from said one end.

9. The device as defined in claim 8 wherein said spring member is integral with said one portion.

10. The device as defined in claim 8 wherein said spring member is canted between said spring one end and said spring free end relative to the longitudinal axis of said one portion in the spring member first normal position.

11. The device as defined in claim 4, wherein said locking means comprises a locking tab on one of said male and female portions and a tab receiver on the other of said male and female portions, said tab receiver including a tab entry zone extending generally axially of said other portion from the terminal end thereof and a tab locking zone spaced from the terminal end of said other portion in communcation with said entry zone, said locking zone receiving said locking tab when said male and female portions are disposed in a predetermined axial relationship with each other and relatively rotated by said biasing means.

12. The device as defined in claim 11 wherein said tab entry zone has a maximum width at the terminal end of said other portion and a minimum width adjacent said locking zone.

13. The device as defined in claim 12 wherein said locking zone extends circumferentially of said other portion and includes a locking surface cooperable with said locking tab in said locking position to prevent axial separation of said male and female portions.

14. The device as defined in claim 11 wherein said locking tab comprises a radial protrusion on said one portion and said tab receiver comprises a groove-like area in said other portion.

15. A device for automatically locking cooperative first and second members in an axially interconnected relationship, at least a generally cylindrical male portion of said first member from a first terminal end being axially receivable in a generally cylindrical female portion of said second member from a second terminal end, said device comprising:

one of said male and female portions including biasing means cooperable with activating means on the other of said male and female portions as said male portion is axially received in said female portion, said activating means causing said biasing means to be moved from a first normal position toward a second biasing position, exerting a biasing force to urge relative rotation between said male and female portions;

locking means cooperable between said male and female portions selectively movable from a first non-locking to a second locking condition, said locking means being automatically moved to said locking condition when a predetermined length of said male portion is received in said female portion and said male and female portions are relatively rotated under the influence of said biasing means; and, said biasing means comprising an elongated spring member associated with said one portion and extending generally axially thereof, said spring member being affixed adjacent one end thereof to said one portion adjacent the terminal end of said one portion and having a free end spaced from said one end, said spring member tapering over the length thereof in said first normal position from said one end to said free end radially inward of said one portion.

16. A device for automatically locking cooperative first and second members in an axially interconnected relationship, at least a generally cylindrical male portion of said first member from a first terminal end being axially receivable in a generally cylindrical female portion of said second member from a second terminal end, said device comprising:

one of said male and female portions including biasing means cooperable with activating means on the other of said male and female portions as said male portion is axially received in said female portion, said activating means causing said biasing means to be moved from a first normal position toward a second biasing position, exerting a biasing force to urge relative rotation between said male and female portions;

locking means cooperable between said male and female portions selectively movable from a first non-locking to a second locking condition, said locking means being automatically moved to said locking condition when a predetermined length of said male portion is received in said female portion and said male and female portions are relatively rotated under the influence of said biasing means; and, said biasing means comprising a pluraity of elongated spring members associated with said one portion and extending generally axially thereof, each said spring member being affixed adjacent one end to said one portion and including a free end spaced from said one end with said pluraity of spring members being disposed in a spaced apart relationship to each other generally circumferentially of said one portion, said activating means comprising a plurality of said activating means spaced around said other portion for cooperative registry with said spring members.

17. The device as defined in claim 16 wherein said plurality of activating means comprise spring member receiving areas in said other portion receiving said spring members when said male portion is received by said female portion, said receiving areas each including a spring member engaging portion for moving the associated of said spring members from said first normal position to said second biasing position.

18. The device as defined in claim 17 wherein each spring member engaging portion comprises a surface for camming the associated spring member to said biasing position when said male portion is received by said female portion.

19. A device for automatically locking a pair of cooperative members which comprise an electrical connector axially interconnected with each other for maintaining an electrically communicating relationship therebetween, at least a first generally cylindrical male portion of one of said members from a first outer end being axially receivable in a second generally cylindrical female portion of the other member from a second outer end, said device comprising:

mechanical biasing means comprising an elongated leaf spring having one end affixed to the interior side wall surface of said female portion and a free end spaced from said one end generally axially of said female portion, said biasing means being selectively movable between normal and biasing conditions; activating means associated with the exterior side wall of said male portion for moving said biasing means from said normal to said biasing condition and urging relative coaxial rotation between said male and female portions as said male portion is axially received by said female portion; a locking tab associated with one of said male and female portions; and, a locking tab receiver associated with the other of said male and female portions for lockingly receiving said tab when said portions are placed in some predetermined axially cooperating relationship, said locking tab and tab receiver being automatically moved into a locking relationship with each other as said male and female portions are relatively rotated under the influence of said biasing means.

20. The device as defined in claim 19 wherein said spring is canted between said one and free ends relative to the longitudinal axis of said female portion in said first normal condition.

21. The device as defined in claim 19 wherein said spring has said one end disposed adjacent said second outer end, said spring tapering over the length thereof in said normal condition from said one end to said free end radially inward of said female portion.

22. The device as defined in claim 19 wherein said activating means comprises an activating groove in the exterior surface of said male portion extending generally axially of said male portion from said first outer end, said activating groove receiving said biasing means and including an activating area engagable by said biasing means for moving said biasing means toward said biasing condition as said male portion is received by said female portion.

23. The device as defined in claim 22 wherein said activating area comprises a cam surface.

24. The device as defined in claim 19 including a plurality of said biasing means integrally formed with said female portion in a spaced apart relationship circumferentially therearound and a plurality of said activating means spaced around said male portion for cooperative registry with said biasing means.

25. The device as defined in claim 19 wherein said tab receiver comprises a tab receiving groove including a tab entry zone extending generally axially of said other portion from the outer end thereof and a tab locking zone spaced from the outer end of said other portion in communication with said entry zone, said locking zone receiving said locking tab when said male and female portions are disposed in a predetermined axial relationship with each other and relatively rotated by said biasing means.

26. The device as defined in claim 25 wherein said tab locking zone extends generally normal to said tab entry zone and includes a locking surface cooperable with said locking tab to prevent axial separation of said male and female portions when said locking tab is lockingly received in said tab locking zone.

27. The device as defined in claim 25 wherein said locking tab comprises a radial protrusion on said one portion.

28. The device as defined in claim 19 including a plurality of said locking tabs integral with said female portion in a spaced apart relationship circumferentially therearound and a plurality of said tab receivers spaced around said male portion for cooperative registry with said locking tabs.

29. A device for automatically locking cooperative first and second members in an axially interconnected relationship, said device comprising:

one of said first and second members including biasing means cooperable with activating means on the other of said first and second members as said members are moved toward an axially interconnected relationship, said activating means including an activating groove extending generally axially along said other member and having an activating area engagable with said biasing means for causing said biasing means to be moved from a first normal position toward a second biasing position exerting a biasing force to urge relative rotation between said first and second members as said members are moved toward an axially interconnected relationship; and, locking means cooperable between said first and second members selectively movable from a first non-locking to a second locking condition, said locking means being automatically moved to said locking condition when said members are placed in a predetermined axial relationship with each other and relatively rotated under the influence of said biasing means.

30. The device as defined in claim 29 wherein said first member includes a generally cylindrical male portion axially receivable in a generally cylindrical female portion included on said second member, one of said male and female positions including said biasing means and the other of said portions including said activating means with said locking means being cooperable between said male and female portions.

* * * * *